US007614194B2

(12) United States Patent
Shah

(10) Patent No.: US 7,614,194 B2
(45) Date of Patent: Nov. 10, 2009

(54) WATER-TIGHT DOUBLE-SIDED ROOF PATCH

(75) Inventor: Vijay G. Shah, Parlin, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 302 days.

(21) Appl. No.: 11/156,139

(22) Filed: Jun. 17, 2005

(65) Prior Publication Data

US 2006/0283134 A1 Dec. 21, 2006

(51) Int. Cl.
*E05B 5/00* (2006.01)

(52) U.S. Cl. ..... 52/410; 42/746.11; 42/DIG. 11; 428/40.1; 428/41.7; 156/74

(58) Field of Classification Search ..... 52/746.11, 52/410–411, 516, DIG. 16, DIG. 11; 411/531, 411/480; 428/40.1, 41.7, 41.8; 156/74, 71, 156/82, 247, 337, 72, 289
See application file for complete search history.

(56) References Cited

U.S. PATENT DOCUMENTS 2,833,327 A * 5/1958 Boyce ..... 152/367
4,135,017 A * 1/1979 Hoffmann, Sr. ..... 428/78
4,437,283 A * 3/1984 Benoit ..... 52/410
4,657,958 A * 4/1987 Fieldhouse et al. ..... 524/247
4,757,652 A * 7/1988 Kalkanoglu ..... 52/420
4,793,116 A * 12/1988 Whitman ..... 52/410
4,852,323 A * 8/1989 Kartfilt ..... 52/410
5,084,119 A * 1/1992 Barksdale ..... 156/157
5,204,148 A * 4/1993 Alexander et al. ..... 428/41.8
5,260,111 A * 11/1993 Valaitis et al. ..... 428/57
5,447,006 A * 9/1995 Zenor ..... 52/741.4
5,800,891 A * 9/1998 Wasitis ..... 428/42.2
5,843,552 A * 12/1998 Karrfalt ..... 428/57
5,888,602 A * 3/1999 Davis et al. ..... 428/40.1
6,004,645 A * 12/1999 Hubbard ..... 428/57
6,080,458 A * 6/2000 Russell et al. ..... 428/41.7
6,586,080 B1 * 7/2003 Heifetz ..... 428/198
6,701,685 B2 * 3/2004 Rippey ..... 52/408
7,146,771 B2 * 12/2006 Swann ..... 52/518
7,234,284 B2 * 6/2007 Paradise et al. ..... 52/745.06

* cited by examiner

*Primary Examiner*—Richard E Chilcot, Jr.
*Assistant Examiner*—Chi Q Nguyen
(74) *Attorney, Agent, or Firm*—William J Davis; Sills Cummis & Gross P.C.

(57) ABSTRACT

A method for sealing joints formed by the intersection and/or overlap of roofing membranes is disclosed. The method comprises the steps of applying strips of double sided tape to roofing membranes so as to secure the membranes to one another and to fill voids created at the intersection of the membranes. Securing the membranes using double-sided tape creates a tight seal which prevents the seepage of water and debris into the joint. A roof joint patch kit is also disclosed which comprises a roll of roofing membrane and a plurality of double-sided tape strips.

7 Claims, 2 Drawing Sheets

WATER-TIGHT DOUBLE-SIDED ROOF PATCH

FIELD OF THE INVENTION

The present invention relates to roofing materials. More particularly, the invention relates to a method for sealing joints formed by the intersection and/or overlap of roofing membranes.

BACKGROUND

Most modified roofing systems are constructed in two layers: a smooth-surfaced base sheet and a granulated cap sheet. Proper seam and joint application is required at both (or all) layers of the sheets. In roofing systems, all seam joints are overlapped and spread over a period of time so that no adjoining sheet seams align.

Single ply membranes are roofing membranes that are field applied using just one layer of membrane material (either homogeneous or composite) rather than multiple layers. Oftentimes as a result of the overlapping intersection of two, three or four sheets of the membrane, a joint is created.

Current joint patches are generally flat membranes with the butyl or similar adhesive applied to one side with a release liner. Often, when applied to intersecting and overlapping portions of a single ply membrane of different heights, the adhesive does not conform to the vertical step in height thus causing bridging and leaving a void into which water and debris can enter.

SUMMARY OF THE INVENTION

When roofing membranes intersect or overlap with one another, joints may be formed at the points of intersection or overlap. A T-joint is a joint formed by the intersection or overlapping of three or four membrane sheets. A butt-joint is a joint formed by adjacent, separate sections of material, such as where two neighboring pieces of roofing membrane abut. Joints also commonly form at the point of attachment of a roof accessory to the roofing membrane. The joints formed by the intersection and/or overlapping of roofing membranes or at the attachment of roofing accessories, can be problematic since the void formed by the joint permits water from precipitation, as well as moisture due to rain or fog, to seep into and underneath the roofing membranes.

A joint patch is provided to alleviate the problem inherent in the formation of "joints" formed as a result of the overlapping intersection of sheets in the roofing membrane. In one embodiment, the patch comprises one or more strips of double-sided tape preferably ranging in length from approximately 1 inch to 9 inches, and having a width ranging from approximately ½ inch to 4 inches. Application of one or more strips of double-sided tape applied to the roof membranes at the joints will allow for the adhesive to bond the membranes to one another and to fill in the void created by the overlapping membranes thus assuring a tight seal.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE FIGURES

These and other features, aspects, and advantages of the apparatus and methods of the present invention will become better understood with regard to the following description, appended claims, and accompanying drawings where:

DETAILED DESCRIPTION

Figure 1:
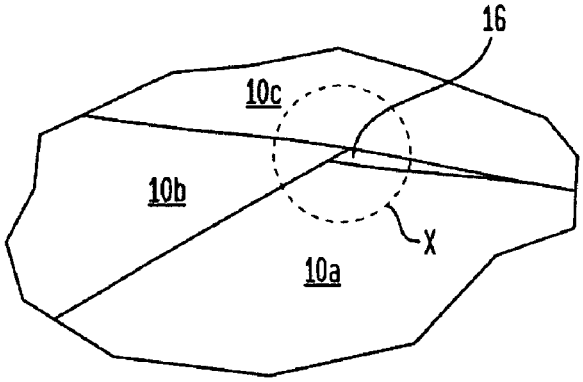
FIG. 1 is a schematic drawing which illustrates the overlap of three membranes to form a T-joint.

The method of the present invention provides for the water-tight sealing of roof membranes at T-joints, end joints and end laps. In FIG. 1, a joint, commonly referred to as a T-joint, (indicated by the circle denoted X) is formed by the intersection of three (3) membranes 10*a*, 10*b*, 10*c*. Using the T-joint solely as an example to describe the method of the present invention, three membranes 10*a*, 10*b* and 10*c* overlap as illustrated in FIG. 1. To avoid seepage of water and debris into the joint, such as at the opening 16 formed at the intersection of membranes 10*a*, 10*b* and 10*c*, opening 16 along with membranes 10*a*, 10*b*, 10*c* can be sealed using strips of double sided tape.

Figure 2:
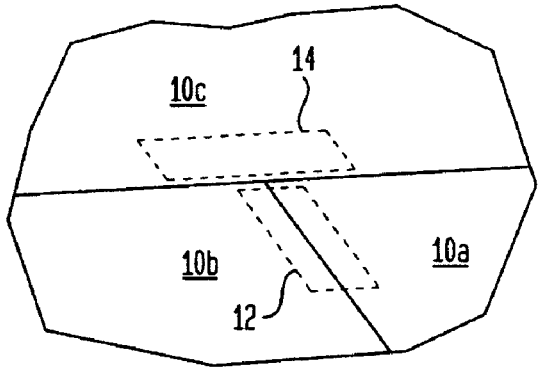
FIG. 2 is a schematic which illustrates the positioning of strips of double-sided tape on roofing membranes in accordance with the present invention.
Figure 3:
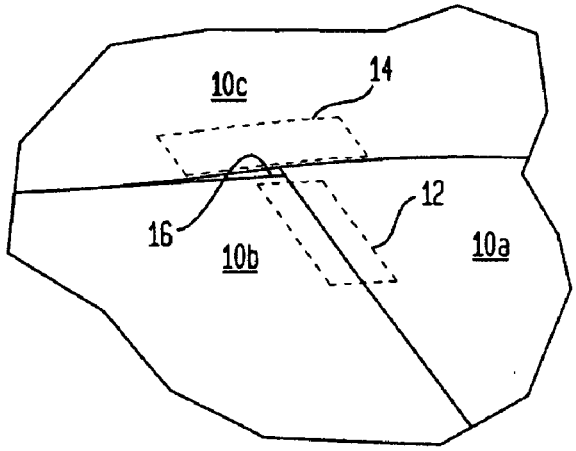
FIG. 3 is schematic drawing illustrating a T-joint formed at the intersection of roofing membranes and illustrating the placement of strips of double-sided tape in accordance with one embodiment of the present invention.
Figure 5:
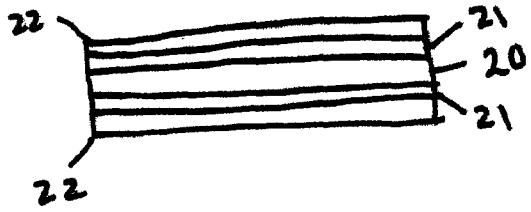
FIG. 5 is a side view of the double-sided tape in accordance with the present invention.

In one embodiment in accordance with the present invention, a first strip of double-sided tape 12 is positioned along the joint formed between two of the three membranes as illustrated in FIGS. 2 and 3. First strip of double-sided tape 12 is shown by broken lines to indicate its position beneath membrane 10*b*. First and second membranes 10*a* and 10*b* form the lower membrane layer. This first strip 12 seals the joint between membranes 10*a* and 10*b*. A second strip of double-sided tape 14 is then positioned perpendicular to first strip of double-sided tape so that the third of the three membranes 10*c* is secured on its underside to the upper surface of membranes 10*a* and 10*c*. Second strip of double-sided tape 14 is shown by broken lines to indicate its position beneath membrane 10*c*. Note that it is of no importance whether second strip of double-sided tape 14 is applied on membranes 10*a* and 10*b*, or applied on membrane 10*c*. In alternative embodiments, a third and fourth strip of double-sided tape may be applied as needed to create the best possible sealing or bonding of the membranes to one another so as to avoid seepage of water into the joint formed between the membranes. The adhesive on the tape is generally a butyl compound or other waterproofing compound such as single component PVAC water-resistant adhesive, water-resistant polyvinyl acetate adhesive, EVA-hot melt adhesives, pressure sensitive hot melt adhesive atactic polypropylene (APP) base pressure sensitive tapes, polyurethane adhesives, thermoplastic adhesive film based with co-polyamides, thermoplastic adhesive film based with mixed polyolefin and co-polyamide, animal base adhesive, asphaltic base adhesive styrol or verstat acrylate tpes, neoprene rubber cementic base adhesive. As shown in FIG. 5, a release liner 22 will generally be layered on adhesive 21 on the strip of tape 20.

Figure 4:
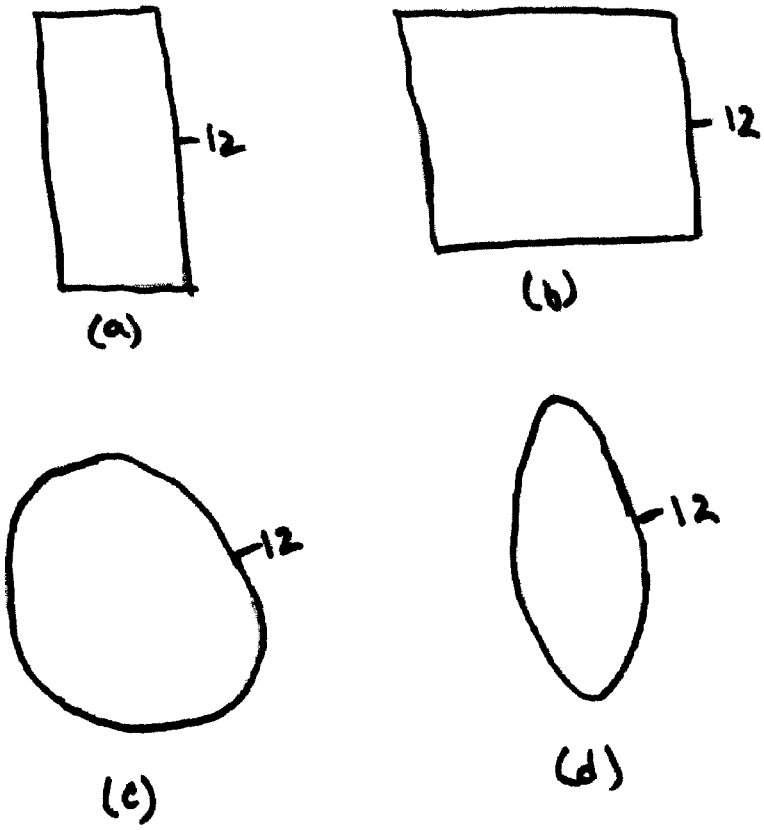
FIGS. 4*a-d* are drawings illustrating various shapes of the double-sided tape in accordance with the present invention.

First and second strips of double-side tape 12, 14 respectively (and any additional strips used), may have a length in the range from approximately 1 inch to 9 inches and have a width of approximately ½ inch to 4 inches. As shown in FIGS. 4(*a*)-(*d*), strips 12, 14 may be of any shape including rectangular FIG. 4(*a*), square FIG. 4(*b*), circular FIG. 4(*c*) or oval FIG. 4(*d*).

The present invention also contemplates a roof patch kit which comprises a roll of roofing membrane, the membrane having first and second ends, and an upper surface and a lower surface, and a plurality of strips (generally two or more) of double-sided tape applied on the first and second ends of the lower surface, the patch having a release liner applied on the exposed side not adhering to the lower surface of the membrane. The membrane may be a single-ply membrane selected from the group consisting of: thermoplastic olefin, polyvinyl chloride, ethylene propylene diene terpolymer or chlorosulfonated polyethylene. As described above, Strips of double-side tape may have a length in the range from approximately 1 inch to 9 inches and have a width of approximately ½ inch to 4 inches.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A roofing patch system for providing a water-tight seal of roof membranes at T-joints comprising:

a top section of roofing membrane, a bottom-right section of roofing membrane and a bottom-left section of roofing membrane, the top section, the bottom-right section and the bottom-left section each having an upper surface and a lower surface;

a T-joint formed by intersecting the top section, the bottom-right section and the bottom-left section, the T-joint having a vertical seam and a horizontal seam; and a first strip and a second strip of double-sided tape, the first and second strips having a length, a width, a top and a bottom, the first strip being positioned beneath the vertical seam with the length of first strip being longitudinally aligned with the vertical seam, and the top of the first strip being in close proximity to the horizontal seam and extending away from the horizontal seam, wherein the second strip bonds the bottom-left and bottom-right sections to one another and assures a tight seal at the vertical seam, and the length of the second strip being longitudinally aligned with the horizontal seam, the length of the second strip being perpendicular to the length of the first strip, the second strip being positioned beneath the horizontal seam so that the second strip is: (a) secured to the bottom surface of the top section and (b) secured to the upper surface of the bottom-right section and the bottom-left section, wherein the second strip bonds the top section to the bottom-right section and the bottom-left section and assures a tight seal at the horizontal seam.

2. The roofing patch system as claimed in claim 1 further comprising:

a release liner layered on the first and second strips of tape.

3. The roofing patch system as claimed in claim 1 wherein the first and second strips of tape is one of a rectangular, square, circular or oval.

4. The roofing patch system as claimed in claim 1 wherein the length of the first and second strips of tape are in a range from approximately 1 inch to 9 inches.

5. The roofing patch system as claimed in claim 1 wherein the width of the first and second strips of tape are in a range of from approximately ½inch to 4 inches.

6. The roofing patch system as claimed in claim 1 wherein the first and second strips of tape are one of a butyl compound, a single component PVAC water-resistant adhesive, a water-resistant polyvinyl acetate adhesive, a EVA-hot melt adhesive, a pressure sensitive hot melt adhesive atactic polypropylene (APP), a base pressure sensitive tape, a polyurethane adhesive, a thermoplastic adhesive film based with co-polyamides, a thermoplastic adhesive film based with mixed polyolefin and a co-polyamide, an animal base adhesive, an asphaltic base adhesive styrol, a verstat acrylate type adhesive and neoprene rubber cementic base adhesive.

7. The roofing patch system as claimed in claim 1 wherein the roofing membrane is one of thermoplastic olefin, polyvinyl chloride, ethylene propylene diene terpolymer and/or chlorosulfonated polyethylene.

* * * * *